US010599080B2

(12) United States Patent
Tsuji

(10) Patent No.: US 10,599,080 B2
(45) Date of Patent: Mar. 24, 2020

(54) FIXING DEVICE AND IMAGE FORMING APPARATUS

(71) Applicant: KYOCERA Document Solutions Inc., Osaka (JP)

(72) Inventor: Hirofumi Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/387,349

(22) Filed: Apr. 17, 2019

(65) Prior Publication Data

US 2019/0324392 A1 Oct. 24, 2019

(30) Foreign Application Priority Data

Apr. 18, 2018 (JP) ..... 2018-079978

(51) Int. Cl.
*G03G 15/20* (2006.01)

(52) U.S. Cl.
CPC ..... *G03G 15/2064* (2013.01); *G03G 15/2039* (2013.01)

(58) Field of Classification Search
CPC ..... G03G 15/2032; G03G 15/2064
See application file for complete search history.

(56) References Cited

U.S. PATENT DOCUMENTS 5,486,908 A * 1/1996 Miyamoto ..... G03G 15/2053 399/328
5,671,474 A 9/1997 Fukano
2007/0020003 A1* 1/2007 Kang ..... G03G 15/206 399/328
2011/0254260 A1* 10/2011 Nakamura ..... G03G 15/20 283/94

FOREIGN PATENT DOCUMENTS

JP 57128374 A * 8/1982 ..... G03G 15/2092
JP H08-190299 A 7/1996

OTHER PUBLICATIONS

Machine translation of JP-57128374-A. Aug. 1982 (Year: 1982).*

* cited by examiner

*Primary Examiner* — Carla J Therrien
(74) *Attorney, Agent, or Firm* — Studebaker & Brackett PC

(57) ABSTRACT

A fixing device includes a casing, a fixing member, a pressuring member, a pressure adjusting part and a correction biasing part.

The fixing member heats a toner image on a medium while rotating inside the casing.

The pressuring member forms a pressuring area with the fixing member while rotating inside the casing to pressure a toner on the medium passing through the pressuring area. The pressure adjusting part presses one of the fixing member and the pressuring member to the other to pressurize the pressuring area, and releases pressing of the one to depressurize the pressuring area.

The correction biasing part, in a case where a supporting shaft part supporting the other by the casing penetrates the casing, biases both sides in an axial direction of the supporting shaft part extended to the outside of the casing in a similar direction to a pressurizing direction of the pressure adjusting part.

14 Claims, 8 Drawing Sheets

FIXING DEVICE AND IMAGE FORMING APPARATUS

INCORPORATION BY REFERENCE

This application is based on and claims the benefit of priority from Japanese Patent application No. 2018-079978 filed on Apr. 18, 2018, the entire contents of which are incorporated herein by reference.

BACKGROUND

The present disclosure relates to a fixing device fixing a toner image on a medium and an image forming apparatus including this fixing device.

An image forming apparatus of an electrographic manner includes a fixing device thermally fixing a toner image on a medium.

For example, the fixing device includes a heating roller, and a pressuring roller pressured to the heating roller. The pressuring roller includes a cylindrical body composed of laminated rubber layers, and a shaft body penetrating the cylindrical body and supporting the cylindrical body via a bearing. Both ends of the cylindrical body are elastically supported by two first elastic supporting mechanisms, and both ends of the shaft body are elastically supported by two second elastic supporting mechanisms. Because the pressuring roller is supported at four points in a longitudinal direction, pressuring force of the pressuring roller to the heating roller becomes uniform in the longitudinal direction, and then, oblique conveyance and jam of a sheet are prevented.

Because the pressuring force of the pressuring roller to the heating roller is very strong in comparison with pressuring force of a pair of rollers for sheet conveyance, the shaft body supporting the heating roller may be slightly warped (bent). However, in the above-mentioned fixing device, warp of the shaft body due to the pressuring force is insufficiently considered. Accordingly, in the above-mentioned fixing device, the pressuring force does not become uniform in the longitudinal direction, and then, there is a program that winkles are caused in the sheet.

The above-mentioned problem may be solved by thickening the shaft body and increasing rigidity of the shaft body. However, because the heating roller is thickened if the shaft body is thickened, there is another problem that the fixing device is enlarged.

SUMMARY

In accordance with the present disclosure, a fixing device includes a casing, a fixing member, a pressuring member, a pressure adjusting part and a correction biasing part. The fixing member heats a toner image on a medium while rotating around an axis inside the casing. The pressuring member forms a pressuring area between the fixing member and the pressuring member while rotating around an axis inside the casing to pressure a toner on the medium passing through the pressuring area. The pressure adjusting part presses one of the fixing member and the pressuring member to the other to pressurize the pressuring area, and releases pressing of the one of the fixing member and the pressuring member to depressurize the pressuring area. The correction biasing part, in a case where a supporting shaft part supporting the other of the fixing member and the pressuring member by the casing penetrates the casing, biases both sides in an axial direction of the supporting shaft part extended to the outside of the casing in a similar direction to a pressurizing direction of the pressure adjusting part.

In accordance with the present disclosure, an image forming apparatus includes the fixing device as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
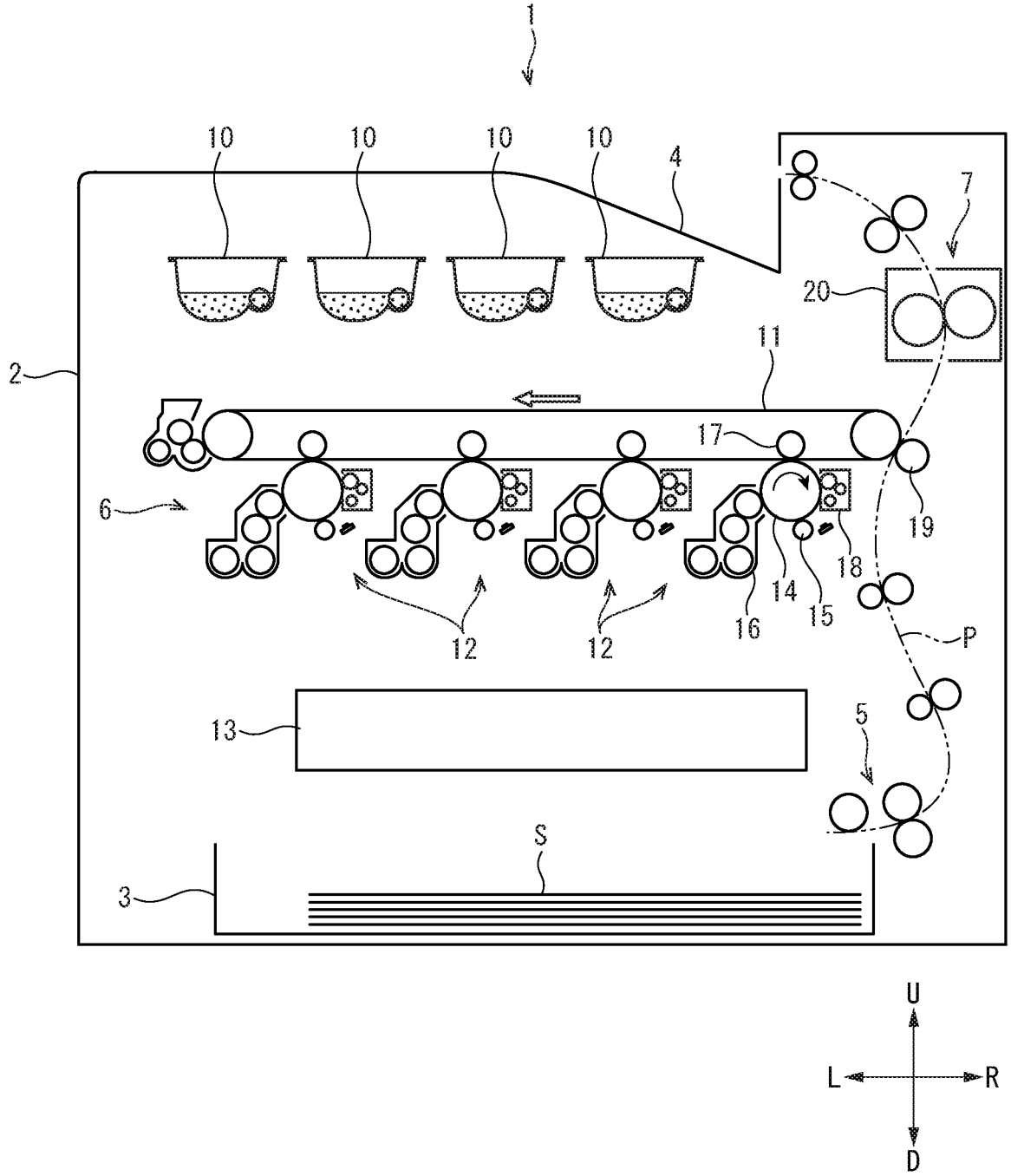
FIG. 1 is a sectional view schematically showing an internal structure of a color printer according to an embodiment of the present disclosure.

Hereinafter, with reference to the accompanying drawings, an embodiment of the present disclosure will be described. Incidentally, in the drawings, a reference character "Fr" indicates a "front" side, a reference character "Rr" indicates a "rear" side, a reference character "L" indicates a "left" side, a reference character "R" indicates a "right" side, a reference character "U" indicates an "upward" side, and a reference character "D" indicates a "downward" side. Moreover, terms "upstream" and "downstream", and other terms similar to these indicate an "upstream" side and a "downstream" side in a conveying direction (a passing direction) of a sheet S and indicate other expressions similar to these.

With reference to FIG. 1, a color printer 1 as an example of an image forming apparatus will be described. FIG. 1 is a sectional view showing an internal structure of the color printer 1 as viewed from a front side.

The color printer 1 includes a roughly rectangular parallelepiped apparatus body 2 constituting an external appearance. At a lower side of the apparatus body 2, a sheet feeding cartridge 3 storing sheets S made of paper as an example of a medium is detachably attached. On an upper face of the apparatus body 2, an ejected sheet tray 4 is provided.

The color printer 1 includes a sheet feeding device 5, an imaging device 6 and a fixing device 7 inside the apparatus body 2. The sheet feeding device 5 is provided in an upstream end of a conveying path P extended from the sheet feeding cartridge 3 to the ejected sheet tray 4. The fixing device 7 is provided at a downstream side in the conveying path P and the imaging device 6 is provided between the sheet feeding device 5 and the fixing device 7 in the conveying path P.

The imaging device 6 includes four toner containers 10, an intermediate transfer belt 11, four drum units 12 and an optical scanning device 13. In the four toner containers 10, toners (developers) of four colors (yellow, magenta, cyan and black) are contained. Each drum unit 12 includes a photosensitive drum 14, a charging device 15, a development device 16, a primary transferring roller 17 and a cleaning device 18. The primary transferring roller 17 is arranged so as to put the intermediate transfer belt 11 between the photosensitive drum 14 and the primary transferring roller 17. With a right side of the intermediate transfer belt 11, a secondary transferring roller 19 comes into contact to form a transferring nip.

A controlling device (not shown) of the color printer 1 suitably controls each component to execute image forming process as follows. The charging device 15 electrically charges a surface of the photosensitive drum 14. The photosensitive drum 14 receives scanning light emitted from the optical scanning device 13 to carry an electrostatic latent image. The development device 16 develops the electrostatic latent image on the photosensitive drum 14 to a toner image by using the toner supplied from the toner container 10. The primary transferring roller 17 primarily transfers the toner image on the photosensitive drum 14 to the intermediate transferring belt 11 being rotated. The intermediate transferring belt 11 rotates and carries the toner image of full color formed by laminating the toner images of four colors. The sheet S is fed out from the sheet feeding cartridge 3 to the conveying path P by the sheet feeding device 5. The secondary transferring roller 19 secondarily transfers the toner image on the intermediate transferring belt 11 to the sheet S passing through the transferring nip. The fixing device 7 fixes the toner image to the sheet S. After that, the sheet S is ejected to the ejected sheet tray 4. The cleaning device 18 removes the toner remained on the photosensitive drum 14.

Figure 2:
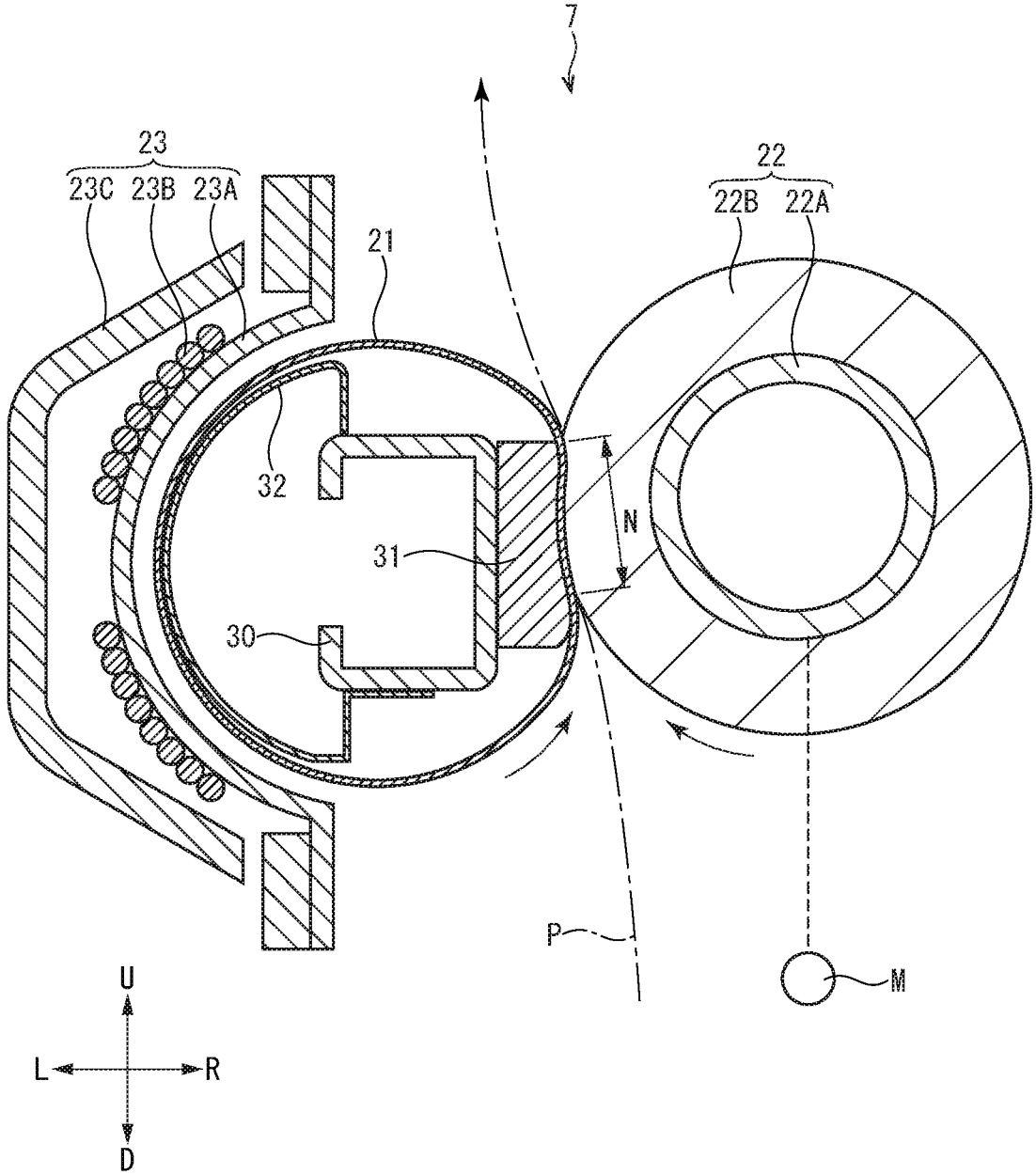
FIG. 2 is a sectional view schematically showing a fixing device according to a first embodiment of the present disclosure.
Figure 3:
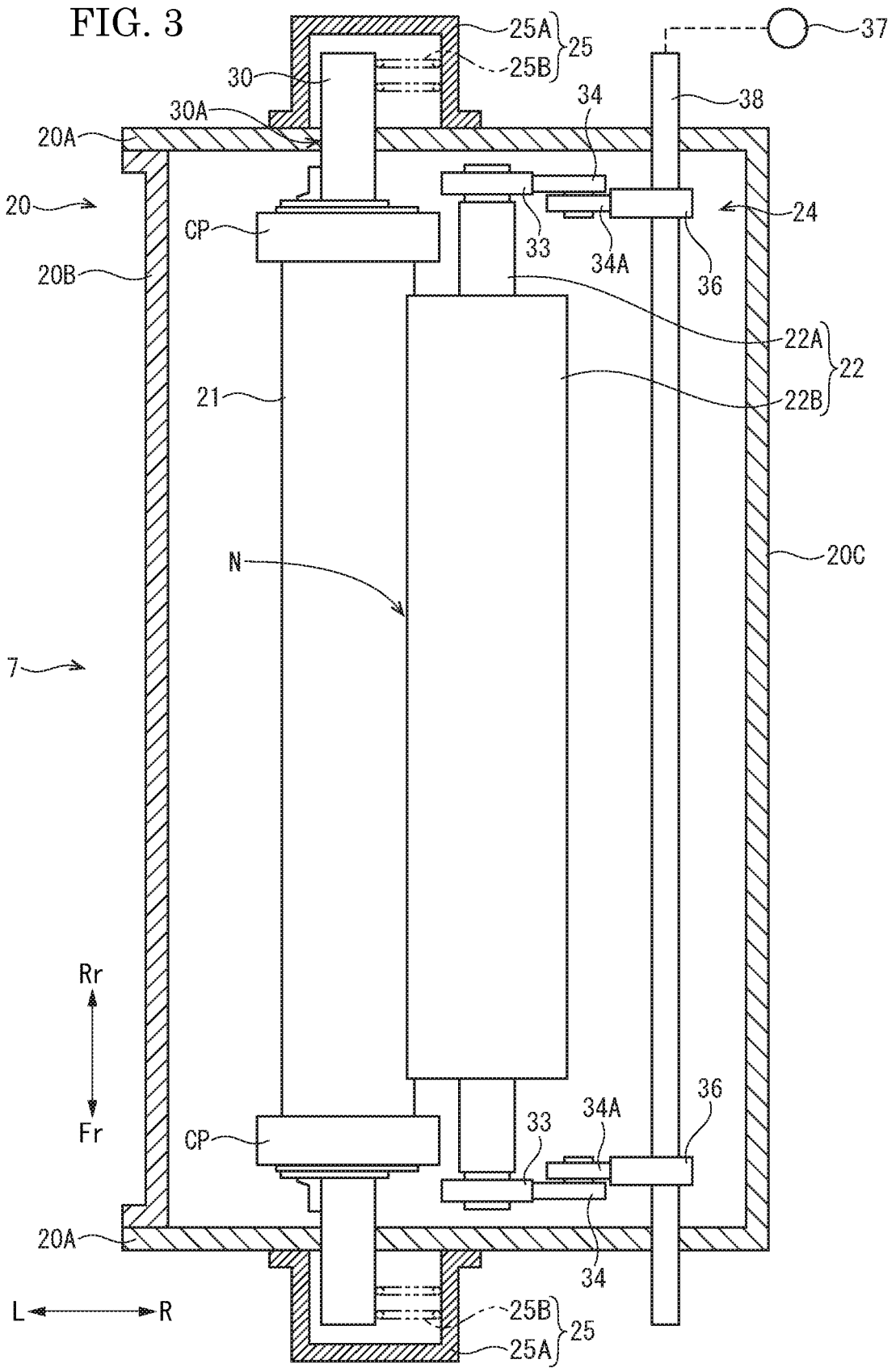
FIG. 3 is a plane view schematically showing the fixing device according to the first embodiment of the present disclosure.
Figure 4:
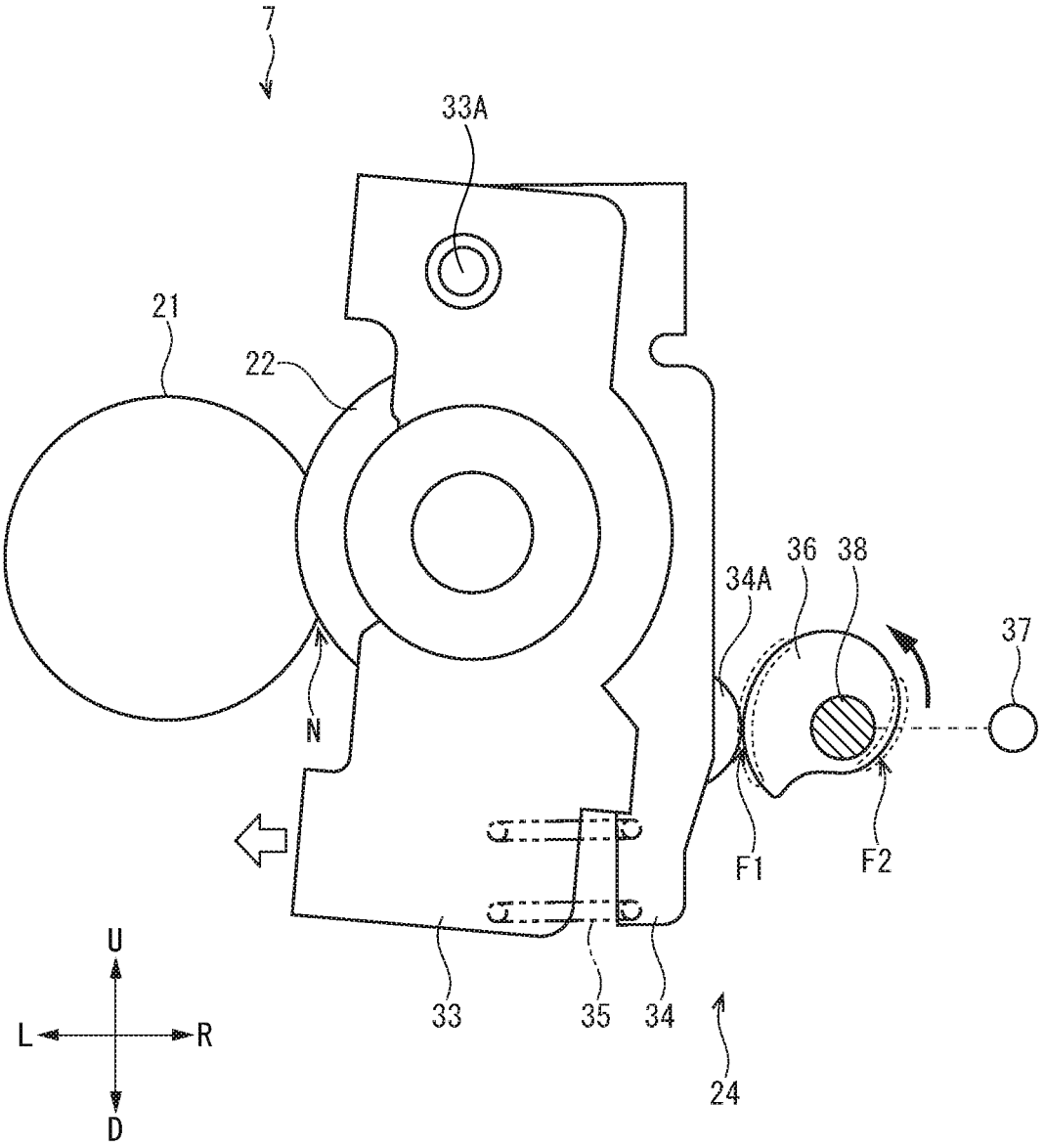
FIG. 4 is a front view showing a pressure adjusting part and others in a pressurizing state in the fixing device according to the first embodiment of the present disclosure.

Next, with reference to FIGS. 2-4, the fixing device 7 according to a first embodiment will be described. FIG. 2 is a sectional view schematically showing the fixing device 7. FIG. 3 is a plane view schematically showing the fixing device 7. FIG. 4 is a front view showing a pressure adjusting part 24 (a pressurizing state) and others.

As shown in FIGS. 2 and 3, the fixing device 7 includes a casing 20, a fixing belt 21, a pressuring roller 22, a heating part 23, the pressure adjusting part 24 and a correction biasing part 25. The casing 20 is supported by the apparatus body 2 (refer to FIG. 1). The fixing belt 21 and the pressuring roller 22 are provided inside the casing 20 so as to be rotated around an axis. The heating part 23 is a heat source heating the fixing belt 21. The pressure adjusting part 24 is a unit adjusting contact pressure of the pressuring roller 22 with respect to the fixing belt 21. The correction biasing part 25 is a unit correcting warp of a supporting shaft part 30 supporting the fixing belt 21.

As shown in FIG. 3, the casing 20 is made of, for example, metal plate and formed in a roughly rectangular parallelepiped shape elongated in forward and backward directions. The casing 20 include a pair of side frames 20A and a reinforcement frame 20B. The pair of side frames 20A are located so as to be separate from each other in the forward and backward directions. To right ends of the pair of side frames 20A, a connecting part 20C is connected, and the pair of side frames 20A and the connecting part 20C are integrally formed in a U-shape opened at a left side as viewed from a front side. The reinforcement frame 20B is installed between left ends of the pair of side frames 20A.

As shown in FIGS. 2 and 3, the fixing belt 21 as an example of a fixing member is an endless belt and is formed in a roughly cylindrical shape elongated in the forward and backward directions. The fixing belt 21 is made of, for example, synthetic resin or the like having heat-resisting property and elasticity. To both front and rear ends of the fixing belt, a pair of caps CP are attached (refer to FIG. 3).

As shown in FIG. 2, inside the fixing belt 21, the supporting shaft part 30, a pressing pad 31 and a belt guide 32 are provided.

As shown in FIGS. 2 and 3, the supporting shaft part 30 as an example of a supporting member is made of, for example, metal material and is formed in a roughly rectangular cylindrical shape elongated in the forward and backward directions (an axial direction). As shown in FIG. 3, the supporting shaft part 30 penetrates the fixing belt in the axial direction. Both sides in the axial direction of the supporting shaft part 30 are extended to the outside of the fixing belt 21 and fixedly attached to (supported by) the pair of side frames 20A. Moreover, both ends in the axial direction of the supporting shaft part 30 penetrate the pair of side frames 20A and are extended to the outside. The supporting shaft part 30 has a function making the fixing belt 21 supported by the casing 20 via the pair of caps CP. That is, the fixing belt 21 is supported by the casing 20 via the supporting shaft part 30 and is provided so as to be rotated around the supporting shaft part 30.

The pressing pad 31 is made of, for example, synthetic resin having heat-resisting property, formed in a roughly rectangular parallelepiped shape longer than the pressuring roller 22 in the axial direction and shorter than the fixing belt 21 in the axial direction. As shown in FIG. 2, the pressing pad 31 is fixedly attached to the supporting shaft part 30 in a state coming into contact with an inner circumferential face of the fixing belt 21 and has a function pressing the fixing belt 21 to the pressuring roller 22. Incidentally, around an outer inner circumferential face of the pressing pad 31, a sliding sheet reducing frictional resistance to the fixing belt 21 is wound (not shown).

The belt guide 32 is made of, for example, metal material, such as stainless with magnetism, and is formed in a roughly semi-cylindrical shape elongated in the axial direction. One end of the belt guide 32 is fixedly attached to the supporting shaft part 30 and a curved face of the belt guide 32 comes into contact with the inner circumferential face of the fixing belt 21 at an opposite side to the pressing pad 31. The belt guide 32 has a function keeping a roughly semi-cylindrical shape of the fixing belt 21.

As shown in FIGS. 2 and 3, the pressuring roller 22 as an example of a pressuring member is formed in a roughly cylindrical shape elongated in the forward and backward directions, and arranged at a right side of the fixing belt 21. The pressuring roller 22 includes a core metal 22A made of metal and an elastic layer 22B, such as silicon sponge, laminated on an outer circumferential face of the core metal 22A. To the pressuring roller 22 (the core metal 22A), a driving motor M is connected via a gear train (not shown). The pressuring roller 22 has a function forming a pressuring area N between the fixing belt 21 and the pressuring roller 22 while rotating around an axis inside the casing 20. Incidentally, the pressuring area N indicates an area within a range from an upstream side position where the pressure is 0 Pa to a downstream side position where the pressure is 0 Pa again via a position where the pressure is a maximum.

As shown in FIG. 2, the heating part 23 is located at an opposite side (a left side) to the pressuring roller across the fixing belt 21. The heating part 23 includes a coil holder 23A, an IH coil 23B and an arch core 23C. The coil holder 23A is formed in a roughly semi-cylindrical shape elongated in the forward and backward directions along an outer face of the fixing belt 21, and is arranged so as to put a gap between the fixing belt 21 and the coil holder 23A. The IH coil 23B is held by the coil holder 23A, and is covered by the arch core 23C made of ferromagnetic material, such as ferrite. Incidentally, as an example of the heat source, although the induction heating type heating part 23 is arranged outside the fixing belt 21, instead of this, a halogen heater, a carbon heater or the like may be arranged inside the fixing belt 21.

As shown in FIGS. 3 and 4, the pressure adjusting part 24 includes a pair of movable arms 33, a pair of adjusting arms 34, a pair of adjusting springs 35, a pair of eccentric cams 36 and a cam motor 37.

The movable arms 33 as an example of a movable member support both ends in the axial direction of the core metal 22A of the pressuring roller 22 so that the core metal 22A is rotatable. The adjusting arms 34 are located at opposite sides (a right side) to the pressuring roller 22 across the movable arms 33. The adjusting arms are connected to rotation shafts 33A of the movable arms 33. The movable arms 33 and the adjusting arms 34 are swingably supported by the casing 20 via the rotation shafts 33A. In lower parts of the pair of adjusting arms 34, a pair of working rollers 34A are rotatably supported. Incidentally, the movable arms 33, the adjusting arms 34 and the working rollers 34A are made of, for example, metal material.

The adjusting springs 35 are so-called coil springs, and are installed between the movable arms 33 and the adjusting arms 34, respectively. The adjusting springs 35 bias the movable arms 33 and the adjusting arms 34 in a separating direction from each other.

The pair of eccentric cams 36 are fixedly attached to a cam shaft part 38 elongated in the forward and backward directions. The cam shaft part 38 is arranged in a roughly parallel to the pressuring roller 22 at a right side of the pressuring roller 22. Both sides in the axial direction of the cam shaft part 38 are rotatably supported by the pair of side frames 20A. Moreover, both ends in the axial direction of the cam shaft part 38 penetrate the pair of side frames 20A, and are extended to the outside. Incidentally, the eccentric cams 36 and the cam shaft part 38 are made of, for example, metal material.

As shown in FIG. 4, the eccentric cams 36 are so-called disk cams having various distances (eccentric diameters) from their rotation centers (the cam shaft part 38) to their outer circumferential faces. The working rollers 34A of the pair of adjusting arms 34 as described above are respectively biased by the adjusting springs 35 and pressed to the outer circumferential faces (cam faces) of the eccentric cams 36. On the circumferential face of each eccentric cam 36, a curved face including a pressurizing cam face F1 and a depressurizing cam face F2 is continuously formed. The eccentric diameter of the pressurizing cam face F1 is set larger than the eccentric diameter of depressurizing cam face F2. Incidentally, each eccentric cam 36 has a curved face shape in which the eccentric diameter is continuously increased and decreased within a whole range including the pressurizing cam face F1 and the depressurizing cam face F2.

The cam motor 37 is connected to a front end of the cam shaft part 38 via a gear train (not shown). The cam motor 37 drives and rotates the eccentric cams 36 (the cam shaft part 38).

Figure 5:
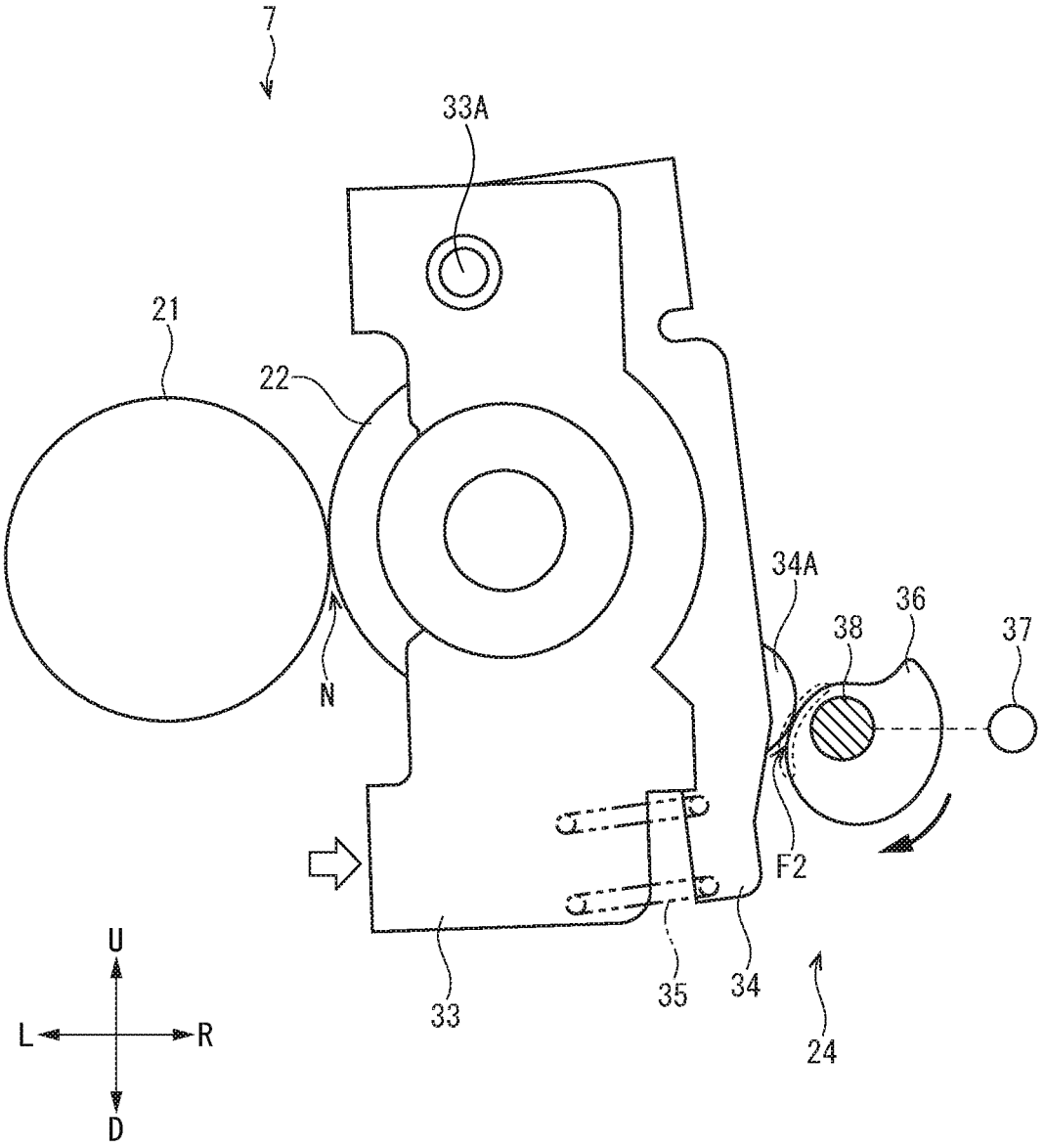
FIG. 5 is a front view showing the pressure adjusting part and others in a depressurizing state in the fixing device according to the first embodiment of the present disclosure.

Next, with reference to FIGS. 4 and 5, an action of the pressure adjusting part 24 will be described. FIG. 5 is a front view showing the pressure adjusting part 24 (a depressurizing state) and others. Incidentally, in the description of the embodiment, in FIGS. 4 and 5, a clockwise rotation is called as a "positive rotation" and a counterclockwise rotation is called as a "negative rotation".

As shown in FIG. 4, in a condition that the pressurizing cam faces F1 of the eccentric cams 36 come into contact with the working rollers 34A, the adjusting arms 34 and the movable arms 33 are pressed to a left side. Therefore, the pressuring roller 22 is strongly pressed to the fixing belt 21 to bite the fixing belt 21, and pressure force in the pressuring area N is increased (a pressurizing state occurs).

As shown in FIG. 5, when the eccentric cams 36 is negatively rotated until the depressurizing cam faces F2 come into contact with working rollers 34A, the adjusting arms 34 and the movable arms 33 are moved to a right side. Therefore, the pressuring roller 22 is moved to a separating direction from the fixing belt 21, and pressure force in the pressuring area N is decreased (a depressurizing state occurs). Incidentally, when the eccentric cams 36 in the depressurizing state is positively rotated and the pressurizing cam faces F1 come into contact with the working rollers 34A, the pressuring area N becomes the pressurizing state again (refer to FIG. 4).

As described above, the pressure adjusting part 24 rotates the eccentric cams 36 fixed to the cam shaft part 38 while bringing the eccentric cams 36 into contact with the movable arms 33 supporting the pressuring roller 22, and thereby, moves the movable arms 33 to vary pressure force of the pressuring area N. Thus, the pressure adjusting part 24 presses the pressuring roller 22 with respect to the fixing belt 21 to pressurize the pressuring area N and releases pressing of the pressuring roller 22 to depressurize the pressuring area N.

Here, an action (fixing process) of the fixing device 7 will be described. Incidentally, in a case of executing the fixing process, the pressuring area N is in the pressurizing state. Moreover, in the casing 20, a temperature sensor (not shown) sensing surface temperature of the fixing belt 21 is provided. The driving motor M, the heating part 23 (the IH coil 23B), the cam motor 37, the temperature sensor and others are electrically connected to the controlling device of the color printer 1 via various driving circuits (not shown).

First, the controlling device controls and drives the driving motor M, the IH coil 23B and others. The pressuring roller 22 is rotated by receiving drive force of the driving motor M, and the fixing belt 21 is rotated by following the pressuring roller 22 (refer to an arrow in FIG. 2).

Next, the IH coil 23B causes a magnetic field by receiving power supply from a power source (not shown) to induction-heat the fixing belt 21. The belt guide 32 self-heats by absorbing leakage magnetic flux passing through the fixing belt 21 to assist heating of the fixing belt 21. The temperature sensor detects surface temperature of the fixing belt 21 and transmits a detection signal to the controlling device via an input circuit. When the controlling device receives the detection signal indicating reaching of setting temperature (e.g. 150-200 degrees centigrade) from the temperature sensor, the controlling device starts execution of the image forming process as described above while controlling the IH coil 23B so as to keep the setting temperature. The sheet S with the transferred toner image is inserted inside the casing 20. The fixing belt 21 heats the toner (the toner image) on the sheet S passing through the pressuring area N while rotating around an axis. The pressuring roller 22 pressurizes the toner on the sheet S passing through the pressuring area N while rotating around an axis. Accordingly, the toner image is fixed on the sheet S. Subsequently, the sheet S with the fixed toner image is fed outside the casing 20 and ejected on the ejected sheet tray 4.

Incidentally, in a case of stopping or pausing the image forming process (the fixing process), the controlling device controls and drives the cam motor 37 to rotate the eccentric cams 36, and makes a state that the depressurizing cam faces F2 of the eccentric cams 36 come into contact with working rollers 34A.

Now, in the pressurizing state, because pressuring force of the pressuring roller 22 with respect to the fixing belt 21 (the pressing pad 31) is very strong in comparison with pressuring force of a pair of rollers for conveying the sheet S, the supporting shaft part 30 supporting the fixing belt 21 may be slightly warped (bent) so as to protrude in a pressurizing direction (a left direction in FIG. 3). When the supporting shaft part 30 is warped, pressuring force on the pressuring area N may not become uniform in the axial direction, and then, a program occurring winkles in the sheet may be caused. Thereupon, the fixing device 7 according to the first embodiment includes the correction biasing part 25 correcting warp of the supporting shaft part 30.

Figure 6:
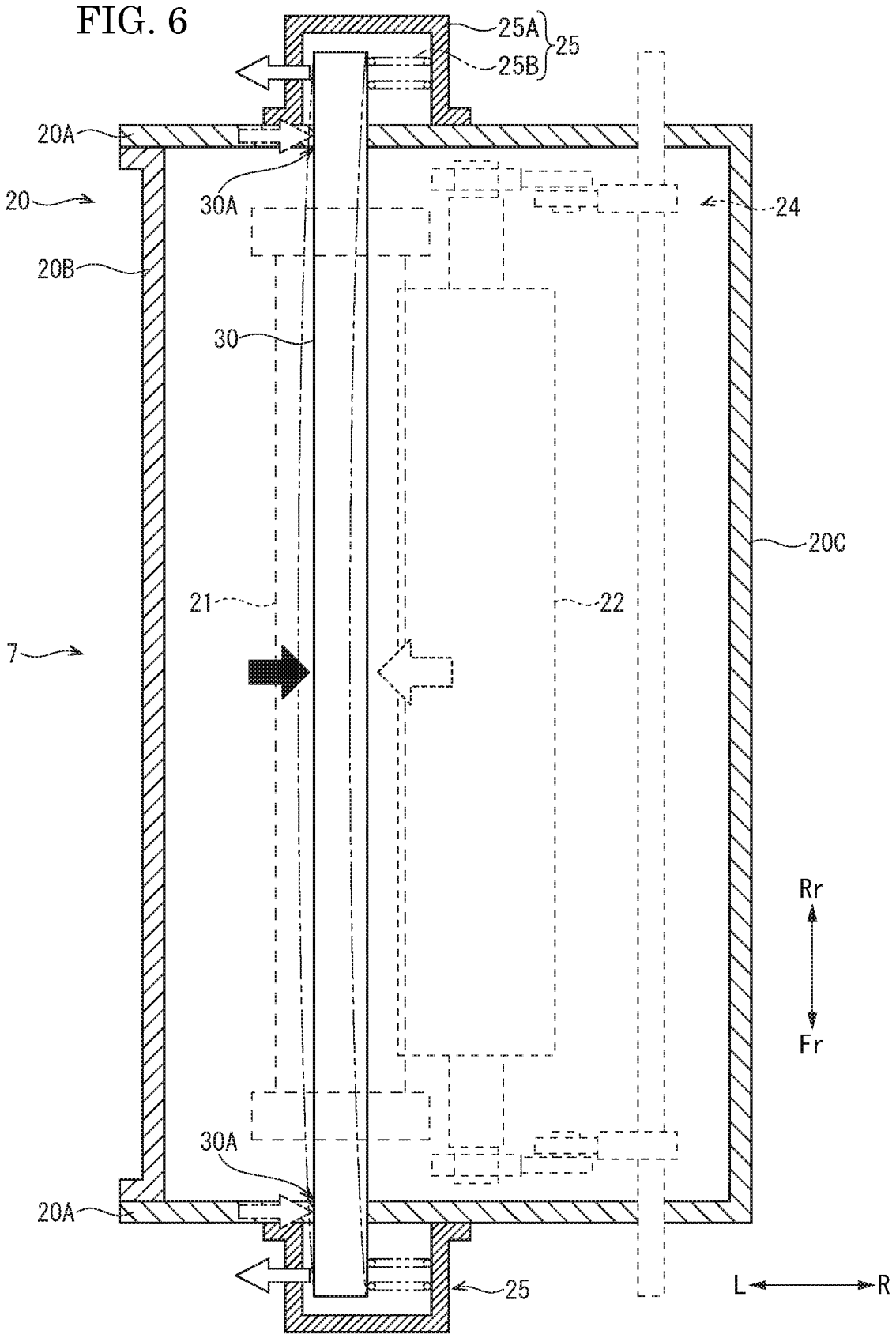
FIG. 6 is a plane view schematically showing the fixing device correcting warp of a supporting shaft part according to the first embodiment of the present disclosure.

With reference to FIGS. 3-6, the correction biasing part 25 will be described. FIG. 6 is a plane view showing the fixing device 7 correcting warp of the supporting shaft part 30.

As shown in FIG. 3, the correction biasing part 25 includes a pair of assistance casings 25A and a pair of biasing members 25B.

Each assistance casing 25A is made of, for example, metal plate and is formed in a box shape having a roughly U-shape section. The pair of assistance casings 25A is fixedly attached to the outside of the casing 20 (the pair of side frames 20A) so as to correspond to both sides in the axial direction of the supporting shaft part 30. In detail, each assistance casing 25A is configured to cover each end of the supporting shaft part 30 projected to the outside by penetrating each side frame 20A. Each assistance casing 25A is made in such a dimension that the supporting shaft part 30 does not interfere in its inner face.

Each biasing member 25B is so-called a coil spring and is located in an inner space of each assistance casing 25A. The pair of biasing members 25B are installed between the pair of assistance casings 25A and both sides in the axial direction of the supporting shaft part 30, respectively. In detail, each biasing member 25B is installed between a right inner face of each assistance casing 25A and each end in the axial direction of the supporting shaft part 30 at a position separated from each side frame 20A to the outside. The pair of biasing members 25B have functions biasing both sides in the axial direction of the supporting shaft part 30 in a similar direction to the pressurizing direction (the left direction in FIG. 3).

As indicated by a two dot chain line in FIG. 6, the supporting shaft part 30 is slightly warped between the pair of side frames 20A by pressuring force (refer to a void arrow indicated by a broken line in FIG. 6) of the pressuring roller 22 so as to be protruded in the pressurizing direction. Incidentally, in FIG. 6, for convenience sake, warp of the supporting shaft part 30 is emphasized. On the other hand, since on both sides in the axial direction of the supporting shaft part 30, biasing force (refer to a void arrow indicated by a solid line in FIG. 6) in the pressurizing direction acts by the pair of biasing members 25B, moment (refer to a black-filled arrow in FIG. 6) occurs in the supporting shaft part 30 so as to restore warp as fulcrums of penetrating portions 30A of the supporting shaft part 30 with respect to the pair of side frames 20A. As a result, as indicated by a solid line in FIG. 6, warp of the supporting shaft part 30 due to pressuring force of the pressuring roller 22 is relaxed.

The fixing device 7 according to the first embodiment as described above is configured that the correction biasing part 25 biases both sides in the axial direction of the supporting shaft part 30 extended to the outside of the casing 20 in a similar direction to the pressurizing direction of the pressure adjusting part 24. According to such a configuration, it is possible to cause moment restoring warp of the supporting shaft part 30 as fulcrums of the penetrating portions 30A of the supporting shaft part 30. Thereby, it is possible to reduce a warp amount (a deformation amount) of the supporting shaft part 30 inside the casing 20 (between the pair of side frames 20A) and to reduce a warp amount of the fixing belt 21 as the fixing member. As a result, it is possible to roughly uniform pressuring force of the pressuring area N in the axial direction and to achieve appropriate fixing process. In addition, since it is unnecessary to increase rigidity of the supporting shaft part 30 in order to reduce the warp amount, it is possible to restrain enlargement (enlarging of the diameter) of the fixing belt 21.

Moreover, when the supporting shaft part 30 is pressed via the fixing belt 21 (the pressing pad 31), force pressing the pair of side frames 20A to the outside in the axial direction acts. Therefore, if there is no reinforcement frame 20B in the casing 20, the pair of side frames 20A may be slightly warped to the outside in the axial direction. By contrast, in accordance with the fixing device 7 according to the first embodiment, since the pair of side frames 20A is connected with the reinforcement frame 20B, it is possible to prevent the pair of side frames 20A from opening to the outside. Thereby, since an interval between the pair of side frames 20A is remained constant, it is possible to appropriately correct warp of the supporting shaft part 30 by the correction biasing part 25.

Figure 7:
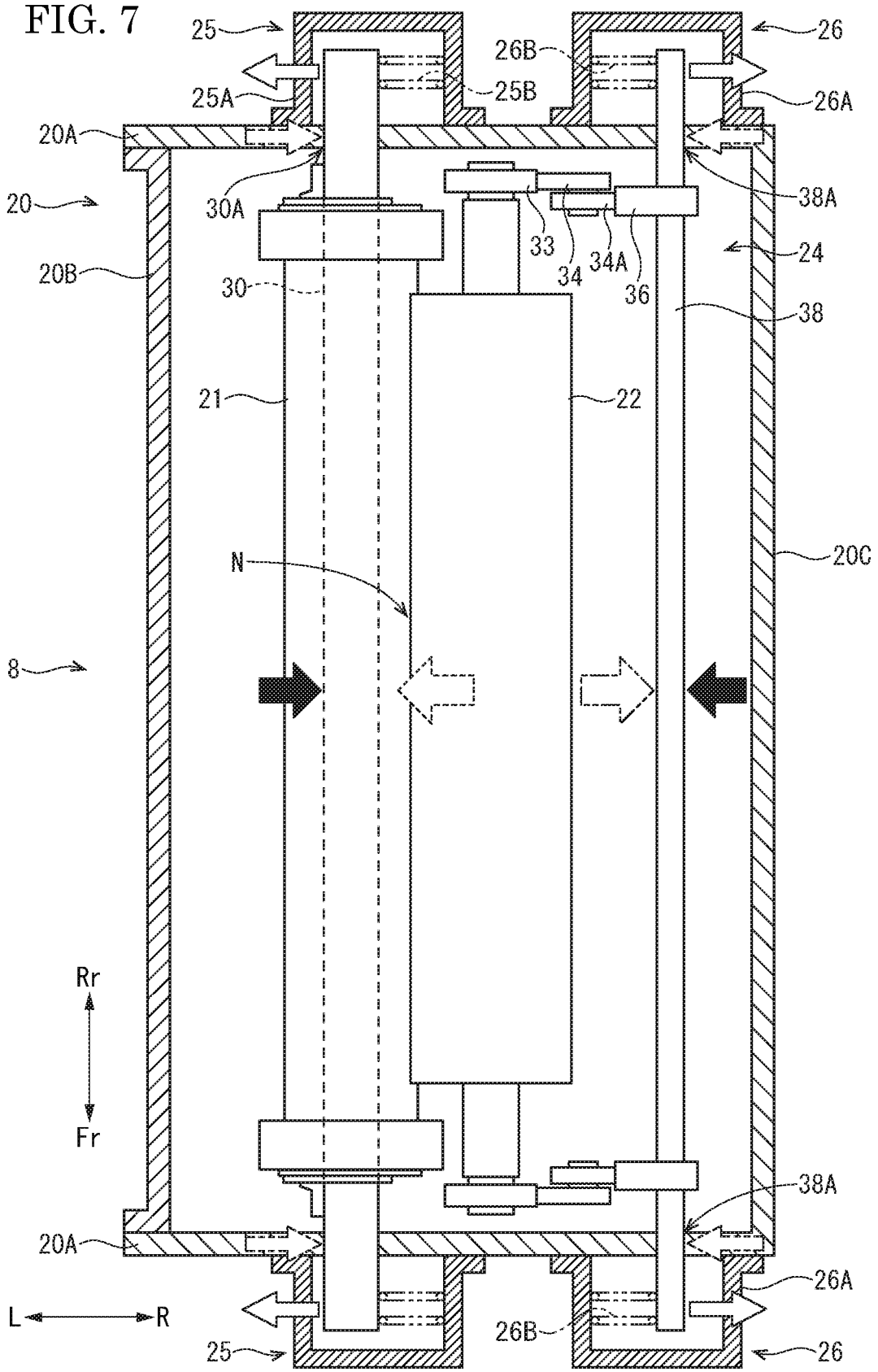
FIG. 7 is a plane view schematically showing the fixing device according to a second embodiment of the present disclosure.

Next, with reference to FIG. 7, the fixing device 8 according to a second embodiment will be described. FIG. 7 is a plane view schematically showing the fixing device 8. Incidentally, in the following description, to similar or corresponding structures to the fixing device 7 according to the first embodiment, the same reference characters are applied, and similar or corresponding description to the fixing device 7 is omitted.

In the fixing device 8 according to the second embodiment, a second correction biasing part 26 corresponding to the pressure adjusting part 24 is provided outside the casing 20. The second correction biasing part 26 includes a pair of second assistance casings 26A and a pair of second biasing members 26B.

Each second assistance casing 26A is formed in the roughly similar shape to each assistance casing 25A. The pair of second assistance casings 26A are fixedly attached to the outside of the casing 20 (the pair of side frames 20A) to correspond to both sides in the axial direction of the cam shaft part 38. In detail, each second assistance casing 26A is configured to cover each end of the cam shaft part 38 projected to the outside by penetrating each side frame 20A. Each second assistance casing 26A is made in such a dimension that the cam shaft part 38 does not interfere in its inner face.

Each second biasing member 26B is so-called a coil spring and is located in an inner space of each second assistance casing 26A. The pair of second biasing members 26B are installed between the pair of second assistance casings 26A and both sides in the axial direction of the cam shaft part 38, respectively. In detail, each second biasing member 26B is installed between a left inner face of each second assistance casing 26A and each end in the axial direction of the cam shaft part 38 at a position separated from each side frame 20A to the outside. The pair of second biasing members 26B have functions biasing both sides in the axial direction of the cam shaft part 38 in an opposite direction to the pressurizing direction (a right direction in FIG. 7). That is, the second correction biasing part 26 has a symmetrical configuration in left and right directions with respect to the correction biasing part 25.

Incidentally, each of bearings (not shown) supporting the cam shaft part 38 rotating around an axis may be provided in each second assistance casing 26A. This bearing may be movably arranged along the pressurizing direction, and each second biasing member 26B may bias the cam shaft part 38 via the bearing.

The cam shaft part 38 is slightly warped between the pair of side frames 20A by reaction force (refer to a void arrow indicated by a dot chain line in FIG. 7) against pressuring force of the pressuring roller 22 so as to be protruded in an opposite direction (the right direction in FIG. 7) to the pressurizing direction. On the other hand, since on both sides in the axial direction of the cam shaft part 38, biasing force (refer to a void arrow indicated by a solid line in FIG. 7) in the opposite direction to the pressurizing direction acts by the pair of second biasing members 26B, moment (refer to a black-filled arrow in FIG. 7) occurs in the cam shaft part 38 so as to restore warp as fulcrums of penetrating portions 38A of the cam shaft part 38 with respect to the pair of side frames 20A. As a result, warp of the cam shaft part 38 due to reaction force against pressuring force of the pressuring roller 22 is relaxed.

The fixing device 8 according to the second embodiment as described above is configured that the second correction biasing part 26 biases both sides in the axial direction of the cam shaft part 38 penetrating the casing 20 and being extended to the outside of the casing 20 in an opposite direction to the pressurizing direction of the pressure adjusting part 24. According to such a configuration, it is possible to cause moment restoring warp of the cam shaft part 38 as fulcrums of the penetrating portions 38A of the cam shaft part 38. Thereby, it is possible to reduce a warp amount (a deformation amount) of the cam shaft part 38 between the pair of side frames 20A. As a result, it is possible to stably carryout pressure adjustment of the pressuring area N by the pressure adjusting part 24 and to achieve appropriate fixing process. In addition, since it is unnecessary to increase rigidity of the cam shaft part 38 in order to reduce the warp amount, it is possible to restrain enlargement of the pressure adjusting part 24.

Figure 8:
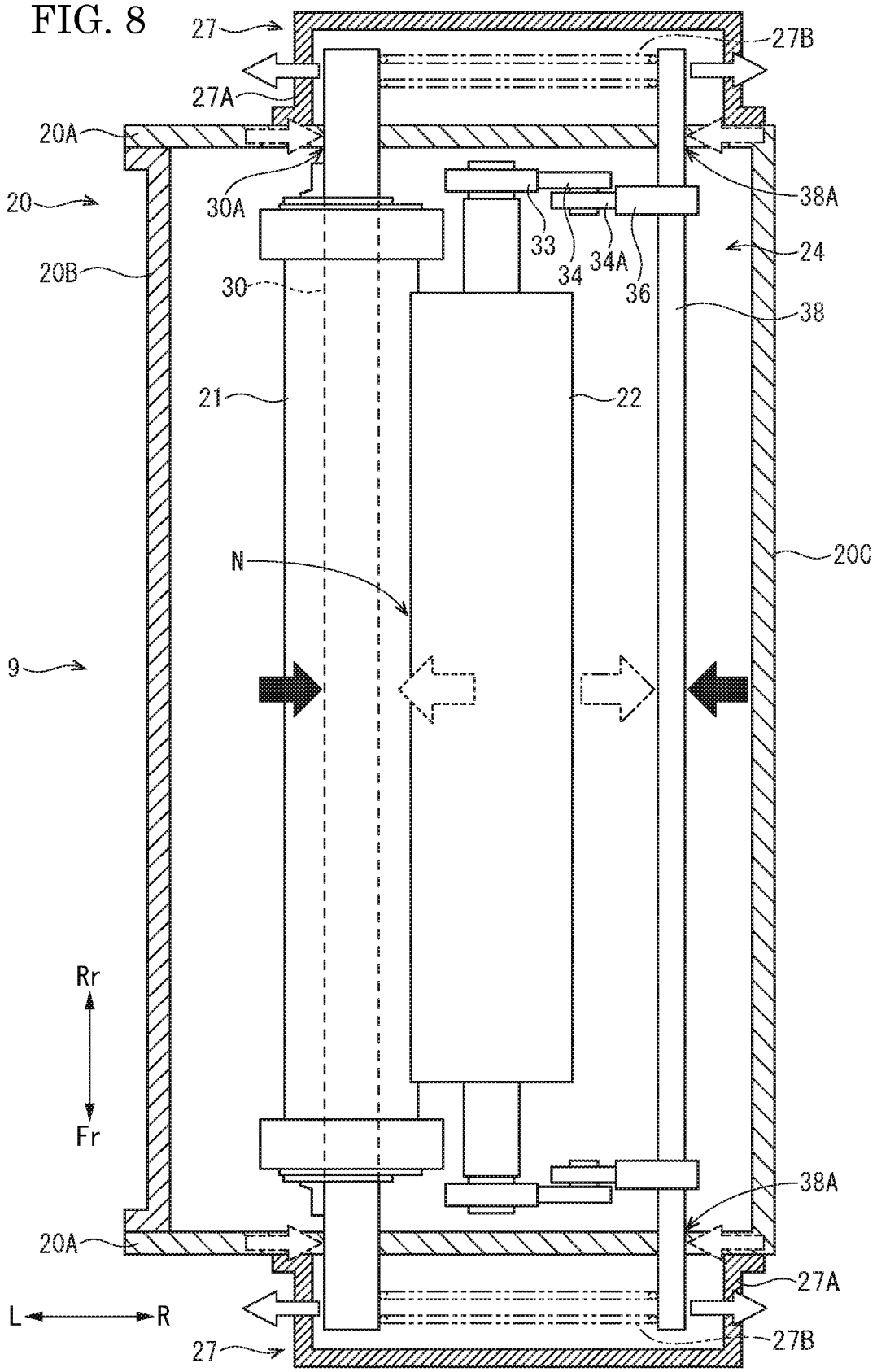
FIG. 8 is a plane view schematically showing the fixing device according to a third embodiment of the present disclosure.

Next, with reference to FIG. 8, the fixing device 9 according to a third embodiment will be described. FIG. 8 is a plane view schematically showing the fixing device 9. Incidentally, in the following description, to similar or corresponding structures to the fixing devices 7 and 8 according to the first and second embodiments, the same reference characters are applied, and similar or corresponding description to the fixing devices 7 and 8 is omitted.

In the fixing device 9 according to the third embodiment, a correction biasing part 27 from the supporting shaft part 30 to the cam shaft part 38 is provided outside the casing 20. The correction biasing part 27 includes a pair of assistance casings 27A and a pair of biasing members 27B.

Each assistance casing 27A is formed in a box shape longer than each assistance casing 25A in the left and right directions. Each assistance casing 27A is configured to cover each end of the supporting shaft part 30 and each end of the cam shaft part 38. Incidentally, in the fixing device 9, each assistance casing 27A may be omitted.

Each biasing member 27B is so-called a coil spring and is located in an inner space of each assistance casing 27A. The pair of biasing members 27B are installed between both sides in the axial direction of the supporting shaft part 30 and both sides in the axial direction of the cam shaft part 38, respectively. The pair of biasing members 27B have functions biasing the supporting shaft part 30 and the cam shaft part 38 in a separating direction from each other (refer to a void arrow in FIG. 8).

In the supporting shaft part 30 and the cam shaft part 38, moment (refer to a black-filled arrow in FIG. 8) occurs so as to restore warp as fulcrums of the penetrating portions 30A of the supporting shaft part 30 and the penetrating portions 38A of the cam shaft part 38 with respect to the pair of side frames 20A. As a result, warps of the supporting shaft part 30 and the cam shaft part 38 are relaxed.

In accordance with the fixing device 9 according to the third embodiment as described above, since moment in a restoring direction acts on the supporting shaft part 30 and the cam shaft part 38, it is possible to reduce the warp amount of the supporting shaft part 30 and the warp amount of the cam shaft part 38 between the pair of side frames 20A.

Incidentally, although, in the fixing devices 7, 8 and 9 according to the first, second and third embodiments, the pressure adjusting part 24 moves the pressuring roller 22 and presses the pressuring roller 22 to the fixing belt 21, the present disclosure is not restricted by this. For example, the pressure adjusting part 24 may be configured to press the fixing belt 21 to the pressuring roller 22 in order to pressurize the pressuring area N, and to release pressing of the fixing belt 21 in order to depressurize the pressuring area N. In such a case, it is preferable that the core metal 22A (the supporting shaft part) supporting the pressuring roller 22 by the casing 20 penetrates the casing 20, and the correction biasing part 25 and others bias both sides in the axial direction of the core metal 22A (the supporting shaft part) extended to the outside of the casing 20 in the similar direction to the pressurizing direction of the pressure adjusting part 24.

Moreover, although, in the fixing device 7 according to the first, second and third embodiments, the pressure adjusting part 24 moves the pressuring roller 22 between two states (the pressurizing state and the depressurizing state), the present disclosure is not restricted by this. For example, by varying a profile of a cam face of each eccentric cam 36, the pressure adjusting part 24 may be configured to move the pressuring roller 22 among three or more states (not shown).

Further, although, in the fixing device 7 according to the embodiments, the pressure adjusting part 24 moves the pressuring roller 22 via the adjusting arms 34 and the adjusting springs 35, the present disclosure is not restricted by this. For example, the adjusting arms 34 and the adjusting springs 35 may be omitted, and the eccentric cams 36 may be rotated while coming into contact with the core metal 22A of the pressuring roller 22 or a bearing or the like supporting the core metal 22A, and thereby, move the pressuring roller 22 (the movable arms 33).

Furthermore, although, in the fixing devices 7, 8 and 9 according to the first, second and third embodiments, the fixing belt 21 is applied as an example of the fixing member, the present disclosure is not restricted by this. For example, as another example of the fixing member, a fixing roller (not shown) formed by laminating an elastic layer made of synthetic resin or a belt on a cylindrical body (the supporting shaft part) made of metal may be applied. It is preferable that both sides of the cylindrical body (the supporting shaft part) penetrate the side frames 20A and are rotatably supported by the side frames 20A. In such a case, it is preferable that movable bearings (not shown) are provided inside the assistance casings 25A or the like, and the biasing members 25B or the like bias the cylindrical body via the bearings, respectively.

Moreover, although, in the fixing devices 7, 8 and 9 according to the first, second and third embodiments, the biasing members 25B, 26B and 27B of the correction biasing part 25, 26 and 27 are coil springs, instead of these, the biasing members 25B, 26B and 27B may be elastic members, such as plate springs or rubbers. In addition, although, in the fixing devices 7, 8 and 9 according to the first, second and third embodiments, the pressuring roller 22 is driven and rotated, instead of this, the fixing belt 21 may be driven and rotated.

Further, although, in the fixing devices 7, 8 and 9 according to the first, second and third embodiments, the reinforcement frame 20B is installed between the pair of side frames 20A, if rigidity of the pair of side frames 20A is sufficiently high, the reinforcement frame 20B may be omitted.

Furthermore, although, in the above-description of the embodiments, a case where the present disclosure is applied to the color printer 1 has been described as one example, the disclosure is not restricted by this, but may be applied to a monochrome printer, a copying machine, a facsimile, a multifunction peripheral or the like.

Incidentally, the above-description of the embodiments illustrates one aspect of the fixing device and the image forming apparatus including this according to the present disclosure, but the technical scope of the disclosure is not limited to the above-described embodiments.

The invention claimed is:

1. A fixing device comprising:

a casing;

a fixing member heating a toner image on a medium while rotating around an axis inside the casing;

a pressuring member forming a pressuring area between the fixing member and the pressuring member while rotating around an axis inside the casing to pressure a toner on the medium passing through the pressuring area;

a pressure adjusting part pressing one of the fixing member and the pressuring member to the other to pressurize the pressuring area, and releasing pressing of the one of the fixing member and the pressuring member to depressurize the pressuring area;

a correction biasing part, in a case where a supporting shaft part supporting the other of the fixing member and the pressuring member by the casing penetrates the casing, biasing both sides in an axial direction of the supporting shaft part extended to the outside of the casing in a same direction to a pressurizing direction of the pressure adjusting part; and a second correction biasing part being provided outside the casing to correspond to the pressure adjusting part, wherein the fixing member is supported by the casing via the supporting shaft part, the pressure adjusting part moves a movable member supporting the pressuring member by rotating an eccentric cam fixedly attached to a cam shaft part and bringing the eccentric cam into contact with the movable member to vary pressuring force of the pressuring area, the second correction biasing part biases both sides in the axial direction of the cam shaft part penetrating the casing and being extended to the outside of the casing in an opposite direction to the pressurizing direction.

2. The fixing device according to claim 1 wherein, the correction biasing part includes:

a pair of assistance casings fixedly attached to the outside of the casing to correspond to both sides in the axial direction of the supporting shaft part; and a pair of biasing members being installed between the pair of assistance casings and both sides in the axial direction of the supporting shaft part and biasing both sides in the axial direction of the supporting shaft part in the same direction to the pressurizing direction, respectively.

3. An image forming apparatus comprising:

the fixing device according to claim 2.

4. The fixing device according to claim 1 wherein, the second correction biasing part includes:

a pair of second assistance casings fixedly attached to the outside of the casing to correspond to both sides in the axial direction of the cam shaft part; and a pair of second biasing members being installed between the pair of second assistance casings and both sides in the axial direction of the cam shaft part and biasing both sides in the axial direction of the cam shaft part in the opposite direction to the pressurizing direction, respectively.

5. An image forming apparatus comprising:

the fixing device according to claim 4.

6. The fixing device according to claim 1, wherein the casing includes:

a pair of side frames supporting both sides in an axial direction of the supporting shaft part; and a reinforcement frame installed between the pair of side frames.

7. The fixing device according to claim 6, wherein the pair of side frames is connected with a connecting part, and the pair of side frames and the connecting part are integrally formed in a U-shape.

8. An image forming apparatus comprising:

the fixing device according to claim 7.

9. An image forming apparatus comprising:

the fixing device according to claim 6.

10. An image forming apparatus comprising:

the fixing device according to claim 1.

11. A fixing device comprising:

a casing;

a fixing member heating a toner image on a medium while rotating around an axis inside the casing;

a pressuring member forming a pressuring area between the fixing member and the pressuring member while rotating around an axis inside the casing to pressure a toner on the medium passing through the pressuring area;

a pressure adjusting part pressing one of the fixing member and the pressuring member to the other to pressurize the pressuring area, and releasing pressing of the one of the fixing member and the pressuring member to depressurize the pressuring area; and a correction biasing part, in a case where a supporting shaft part supporting the other of the fixing member and the pressuring member by the casing penetrates the casing, biasing both sides in an axial direction of the supporting shaft part extended to the outside of the casing in a same direction to a pressurizing direction of the pressure adjusting part, wherein the fixing member is supported by the casing via the supporting shaft part, the pressure adjusting part moves a movable member supporting the pressuring member by rotating an eccentric cam fixedly attached to a cam shaft part and bringing the eccentric cam into contact with the movable member to vary pressuring force of the pressuring area, the correction biasing part includes a pair of biasing members being installed between both sides in the axial direction of the supporting shaft part and both sides in the axial direction of the cam shaft part, respectively, and biasing the supporting shaft part and the cam shaft part in a separating direction from each other.

12. An image forming apparatus comprising:

the fixing device according to claim 11.

13. A fixing device comprising:

a casing;

a fixing member heating a toner image on a medium while rotating around an axis inside the casing;

a pressuring member forming a pressuring area between the fixing member and the pressuring member while rotating around an axis inside the casing to pressure a toner on the medium passing through the pressuring area;

a pressure adjusting part pressing one of the fixing member and the pressuring member to the other to pressurize the pressuring area, and releasing pressing of the one of the fixing member and the pressuring member to depressurize the pressuring area; and a correction biasing part, in a case where a supporting shaft part supporting the other of the fixing member and the pressuring member by the casing penetrates the casing, biasing both sides in an axial direction of the supporting shaft part extended to the outside of the casing in a same direction to a pressurizing direction of the pressure adjusting part, wherein the correction biasing part includes:

a pair of assistance casings fixedly attached to the outside of the casing to correspond to both sides in the axial direction of the supporting shaft part; and a pair of biasing members being installed between the pair of assistance casings and both sides in the axial direction of the supporting shaft part and biasing both sides in the axial direction of the supporting shaft part in the same direction to the pressurizing direction, respectively, the casing includes:

a pair of side frames supporting both sides in an axial direction of the supporting shaft part; and a reinforcement frame installed between the pair of side frames, the pair of assistance casings are configured to cover both ends of the supporting shaft part projected to the outside by penetrating the pair of side frames, the pair of biasing members are arranged at positions separated from the pair of side frames to the outside, respectively.

14. An image forming apparatus comprising:

the fixing device according to claim 13.

* * * * *